United States Patent [19]

Rachofsky

[11] Patent Number: 4,541,726

[45] Date of Patent: Sep. 17, 1985

[54] TWENTY-FIVE (25) HOUR CLOCK

[76] Inventor: Morton Rachofsky, 5511 Stonegate Rd., Dallas, Tex. 75209

[21] Appl. No.: 650,730

[22] Filed: Sep. 17, 1984

[51] Int. Cl.[4] ..... G04B 19/04

[52] U.S. Cl. ..... 368/80; 368/220; 368/228

[58] Field of Search ..... 368/220, 221, 223, 228, 368/232, 76, 80, 82–84

[56] References Cited

U.S. PATENT DOCUMENTS 4,175,378 11/1979 Shelton ..... 368/20

*Primary Examiner*—Vit W. Miska

*Attorney, Agent, or Firm*—David H. Judson

[57] ABSTRACT

A clock for representing twenty-five (25) simulated hours in a twenty-four (24) hour real-time day is provided. The clock preferably includes a clock face having indicia printed thereon at twenty-five (25) equally-spaced intervals, each of the intervals representing a simulated hour in a twenty-five (25) hour simulated day. The clock includes a conventional hour and minute hand for cooperating with the clock face to provide a time indication. A clock drive mechanism simultaneously drives the minute hand around the clock face, and the hour hand between spaced intervals, in 1/25th of the twenty four hour real-time day. The clock may also be provided with a second hand driven by the clock drive mechanism around the clock face in 24/25th's of a real-time minute.

7 Claims, 6 Drawing Figures

FIG. 1
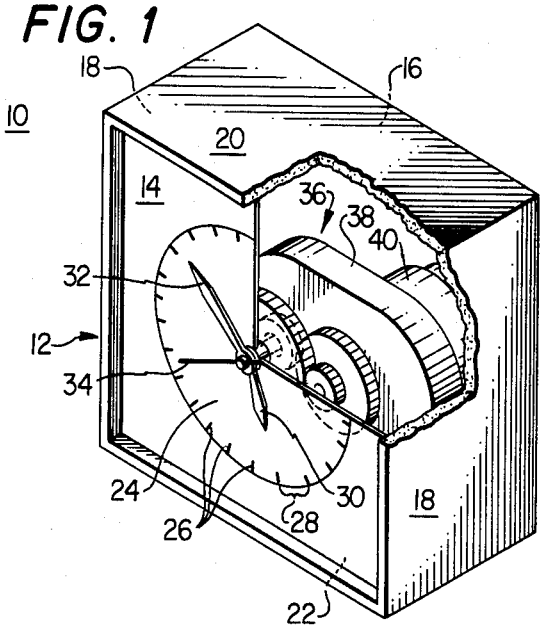
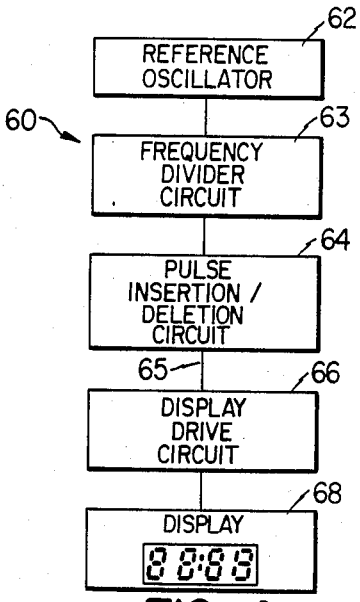
FIG. 4
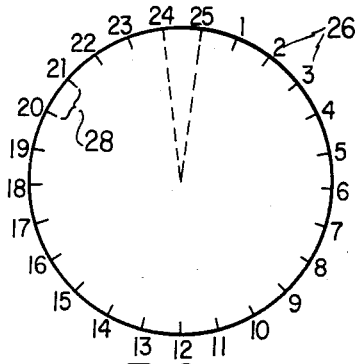
FIG. 2a
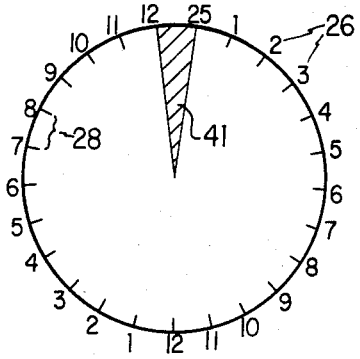
FIG. 2b
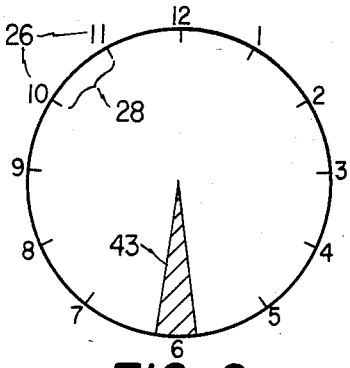
FIG. 2c
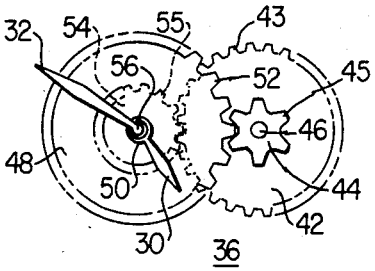
FIG. 3

TWENTY-FIVE (25) HOUR CLOCK

TECHNICAL FIELD

The present invention relates generally to clock mechanisms, and more particularly to a clock for indicating twenty-five (25) simulated hours in a twenty-four (24) hour real-time day.

BACKGROUND OF THE INVENTION

A common complaint in today's fast-paced society is that there are not enough hours in the day to accomplish one's daily tasks. The cause of such complaint, however, is not of course due to an insufficient number of hours in a day; but rather one's failure to appropriately regulate his or her daily schedule or routine. This problem is exacerbated over time as one becomes conditioned to follow the same schedule or routine on a daily basis.

Scientific studies have confirmed that the human body tends to function on a twenty-five (25) hour biological system rather than the conventional twenty-four (24) hour system tied to the earth's rotation. The body's tendency to function on a twenty-five (25) hour biological clock, however, cannot be utilized advantageously since conventional timekeeping is tied to the twenty-four (24) hour hour real-time day. The twenty-five (25) hour biological clock does, however, suggest a way of ameliorating daily scheduling problems; using a twenty-five (25) simulated hour clock to provide a person with the feeling of having one extra hour per day to accomplish daily tasks.

There is therefore a need to provide a device to aid those people who are so inclined to regulate their schedules, routines and bodies to a day having twenty-five (25) simulated hours in a twenty-four (24) hour real-time day.

BRIEF SUMMARY OF THE INVENTION

Accordingly, the present invention describes a clock for indicating twenty-five (25) simulated hours in a twenty-four (24) hour real-time day. The clock preferably includes a clock face having indicia printed thereon at twenty-five (25) equally-spaced intervals, each of the intervals representing a simulated hour in a twenty-five (25) simulated hour day. The clock includes conventional hour, minute and second hands for cooperating with the clock face to provide a time indication. A clock drive mechanism drives the second hand around the clock face in 24/25th's of a real-time minute, and the minute hand around the clock face in 24/25th's of a real-time hour. Thus the hour hand is driven between spaced "hour" intervals in 1/25th of a twenty-four (24) hour real-time day.

According to the present invention, the printed indicia is appropriately selected to form either a "25 hour" clock face having the sequential numerals "1–25", or a "12—12 hour" clock face having a set of sequential numerals "1–12" on each side of the clock face and additional indicia representing the twenty-fifth (25) simulated hour of the day.

In an alternate embodiment of the invention, the printed indicia on the clock face represents a "12.5 hour" clock face. In this embodiment, the clock drive mechanism operates to drive the hour hand twice around the clock face during the twenty-four (24) hour real-time day.

BRIEF DESCRIPTION OF THE DRAWINGS

For a more complete understanding of the present invention and the advantages thereof, reference is now made to the following Description, taken in conjunction with the accompanying Drawings in which:

FIG. 1 is a perspective view of the twenty-five (25) hour clock of the present invention for indicating twenty-five (25) simulated hours in a twenty-four (24) hour real-time day;

FIGS. *2a–c* show representative clock faces for use in the twenty-five (25) hour clock of FIG. 1;

FIG. 3 shows a schematic representation of a clock drive mechanism for driving the hour and minute hands of the present invention; and FIG. 4 shows a schematic representation of a suitable digital clock drive mechanism for driving a conventional digital readout for the twenty-five (25) hour clock.

DETAILED DESCRIPTION

With reference now to the FIGURES wherein like reference characters designate like or similar parts throughout the several views, FIG. 1 is a perspective view of the twenty-five (25) hour clock 10 of the present invention. This clock indicates twenty-five (25) simulated hours in a twenty-four (24) hour real-time day. As used herein, the term "twenty-four (24) hour real-time day" refers to the twenty-four (24) hour timekeeping convention tied to the earth's rotation. The clock 10 includes a housing 12 having front and back walls 14 and 16, side walls 18, top wall 20 and a base 22. Preferably, the clock includes a clock face 24 having indicia 26 printed thereon at twenty-five (25) equally-spaced intervals 28, each of the intervals representing a simulated "hour" in a twenty-five (25) hour simulated day. The clock 10 also includes a conventional hour hand 30, minute hand 32 and second hand 34. The clock hands 30, 32 and 34 are driven by a suitable clock drive mechanism 36 for simultaneously driving the hands around the clock face 24. Although not shown in detail, the clock drive mechanism 36 is driven through a gear reduction motor 38 by a suitable power source such as an electric motor 40. Equivalent types of power sources may be used in place of the electric motor 40 as is well known in the art. The clock 10 also preferably includes a conventional clock setting mechanism (not shown) for manual setting of the hour and minute hands 30 and 32. The clock setting mechanism allows the user to reset the clock movement at any convenient time of the twenty-four (24) hour real-time day.

The twenty-five (25) hour clock 10 may be used advantageously by those people who are so inclined to regulate their schedules, routines and bodies to a day having twenty-five (25) simulated hours in a twenty-four (24) hour real-time day. The clock allows tasks to be completed in a shorter time frame and gives a person the feeling of having one extra hour per day. This extra hour, although simulated, serves to increase task efficiency by a factor of over four (4%) percent.

The theory of operation of the twenty five hour clock 10 of the present invention can be seen by considering Table I below:

TABLE I

| Seconds | Minutes | Hours | Total Seconds/Day |
|---|---|---|---|
| 57.6 × | 60 × | 25 | = 86,400 (25 simulated hrs) |

TABLE I-continued

| Seconds | Minutes | Hours | Total Seconds/Day |
|---|---|---|---|
| 60 × | 60 × | 24 | = 86,400 (24 real-time hrs) |

As seen in the above table, every minute in the twenty-five (25) simulated hour system includes only 24/25th's of a real-time minute, or 57.6 real-time seconds. Thus, the invention takes advantage of the saving of 2.4 real-time seconds every real-time minute to form the one extra simulated hour (57.6 real-time minutes long) every twenty-four (24) hour real-time day.

Referring simultaneously to FIGS. *2a–c*, various embodiments of the clock face 24 of the clock 10 are shown. In the preferred embodiment of FIG. *2a*, a "25 hour" clock face is shown wherein the indicia 26 comprise the sequential numerals "1–25" located at the twenty-five (25) equally-spaced intervals 28. Each of the intervals 28 represents a simulated "hour" in the twenty-five (25) hour simulated day, and each is separated by 14.4° (since 14.4°×25 intervals=360°). In FIG. *2b*, a "12—12 hour" clock face is shown wherein the indicia 26 comprise sets of sequential numerals "1–12" located on each side of the clock face 24, with an additional interval 41 representing the twenty-fifth (25) simulated hour in the twenty-five (25) hour simulated day.

In FIG. *2c*, the indicia 26 on the clock face 24 are located at twelve intervals, each of the intervals being 28.8° apart. An additional segment 43 of 14.4° is also used on this face to represent the extra simulated hour per day. This extra hour is allocated to one-half hour per each half day. Table II below sets forth the various timing (real-time) relationships among the clock faces 24 shown in FIGS. *2a–c*.

TABLE II

| | "25 Hour" | "12—12 Hour" | "12.5 Hour" |
|---|---|---|---|
| Hour Hand: | 1 rev./day | 1 rev./day | 2 rev./day |
| Minute Hand: | 1 rev./57.6 min. | 1 rev./57.6 min. | 1 rev./57.6 min. |
| Second Hand | 1 rev./57.6 sec. | 1 rev. 57.6 sec. | 1 rev./57.6 sec. |

As shown in Table II, using the "12.5 hour" face of FIG. *2c*, the hour hand 30 makes two complete revolutions per twenty-four (24) hour real-time day. However, the minute hand 32 and second hand 34 move in the same fashion as with the twenty-five (25) hour clock faces of FIGS. *2a* and *2b*.

Referring now to FIG. 3, a suitable clock drive mechanism 36 is shown for the twenty-five (25) hour clock face of FIG. *2a*. As noted above, with the twenty-five (25) hour clock face, the hour hand 30 is driven at a speed of one revolution around the clock face 24 per twenty-four (24) hour real-time day. The minute hand 32 is driven at a speed of one revolution per 24/25th's real-time minutes. The hour hand 30 is thus driven between a "hour" interval in 1/25th of the twenty-four (24) hour real-time day.

Referring to FIG. 3, the clock drive mechanism 36 includes a gear wheel 42 and pinion 44 mounted on a spindle 46 for rotation therewith. The spindle 46 is driven by a suitable power source such as the electric motor 40 as described above with respect to FIG. 1. As also shown in FIG. 3, an hour wheel 48 is mounted on a spindle 50 to drive the hour hand 30 around the clock face. The hour wheel 48 includes teeth 52 which mesh with teeth 45 of the pinion 44, and thus the hour wheel 48 is driven thereby. Likewise, a minute wheel 54 is mounted on a spindle 56 to drive the minute hand 32. To this end, the minute wheel 54 includes teeth 55 which mesh with the teeth 43 of the gear wheel 42, and thus the minute wheel 54 is driven thereby.

According to the present invention, once the speed of the electric motor 38 is determined, the circumference of the hour wheel 48 and the number of teeth 52 therein are appropriately sized to drive the hour hand 30 at a speed of one revolution around the clock face 24 per 24/25th's real-time minutes. Accordingly, the hour hand 30 moves between spaced intervals 28 in 1/25th of the twenty-four (24) hour real-time day. Likewise, the circumference of the minute wheel 54 and the number of teeth 55 therein are appropriately sized to drive the minute hand 32 around the clock face 24 in 24/25th of a real-time hour. Although not shown in FIG. 3, the second hand 34 also includes a second wheel which is appropriately sized to drive the second hand 34 of FIG. 1 around the clock face 24 in 24/25th's of a real-time minute.

The clock drive mechanism 36 of FIG. 3 may also be utilized in conjunction with the clock face 24 shown in FIG. *2b* since the hour hand 30 therein also makes one revolution per twenty-four (24) hour real-time day. Although not shown in detail, the clock drive mechanism 36 may also be suitably modified to drive the hour hand 30 two times around the clock face 24 in a twenty-four (24) hour real-time day. In such an embodiment, the clock face 24 shown in FIG. *2c* is used.

Therefore, it can be seen that the present invention describes a unique clock mechanism for representing twenty-five (25) simulated hours in a twenty-four (24) hour real-time day. The twenty-five (25) hour clock is advantageous to those people who are so inclined to regulate their schedules, routines and bodies in such a way as to increase their efficiency by a factor of over four (4%) percent in a twenty-four (24) hour real-time day. To this end, the present invention may be used to assist a person in adjusting to a twenty-five (25) hour (57.6 real-time) minute cycle that allows tasks to be completed in a shorter time frame and provides a person with the feeling of having one extra hour per day.

Although in the preferred embodiment of the invention, the twenty-five (25) hour clock includes a clock face 24 having indicia printed thereon in twenty-five (25) equally-spaced intervals such as shown in FIGS. *2a–2b*, it should be appreciated that the clock face may also comprise a digital readout representing twenty-five (25) simulated hours.

Referring now to FIG. 4, a simplified schematic diagram is shown detailing a suitable digital clock drive mechanism 60 for use in an electronic version of the twenty-five (25) hour clock. The drive mechanism 60 includes a reference oscillator 62 generating a predetermined frequency. The output of the oscillator 62 is divided by a frequency divider circuit 63 and applied to a pulse insertion/deletion circuit 64. The pulse insertion/deletion circuit 64 is suitably controlled (by a microprocessor or other conventional control circuit) to insert or delete pulses as needed in the pulse train to generate a clock signal on line 65. The clock signal is appropriately selected to generate a 57.6 second "simulated minute" and a 57.6 minute "simulated hour". This clock signal is then supplied to a conventional display drive circuit 66 which drives an LCD or LED display 68. The actual display readout will reset to "00:00" at the beginning of the twenty-four (24) hour real-time day and go up to 24:59" at the end of the twenty-four (24) hour real-time day. Although not shown in detail, the drive mechanism is driven by a suitable power source, such as a rechargeable battery. The electronic version of the clock also includes a conventional clock setting mechanism.

Although preferred embodiments of the invention have been described in the foregoing Detailed Description and illustrated in the accompanying Drawings, it will be understood that the invention is not limited to the embodiments disclosed, but is capable of numerous rearrangements, modifications and substitution of parts and elements without departing from the spirit of the invention. Accordingly, the present invention is intended to encompass such rearrangements, modifications and substitutions of parts and elements as fall within the spirit and scope of the appended claims.

I claim:

1. A clock, comprising:

a clock face having indicia printed thereon at twenty-five (25) equally-spaced intervals, each of said intervals representing a simulated hour in a twenty-five (25) hour simulated day;

clock hand means including an hour hand and a minute hand for cooperating with said clock face to provide a time indication; and drive means for simultaneously driving said minute hand around said clock face and said hour hand between spaced intervals in 1/25th of said twenty-four (24) hour real-time day, whereby said clock represents twenty-five (25) simulated hours in a twenty-four (24) hour real-time day.

2. The clock for representing twenty-five (25) simulated hours as described in claim 1, wherein said clock hand means includes a second hand for cooperating with said clock face to provide a time indication.

3. The clock for representing twenty-five (25) simulated hours as described in claim 2 wherein said drive means drives said second hand around said clock face in 24/25th's of a real-time minute.

4. A clock for representing twenty-five (25) simulated hours as described in claim 1 wherein said indicia printed on said clock face includes the numerals "1–25" repesenting twenty-five (25) simulated hours in said twenty-five (25) hour simulated day.

5. The clock for representing twenty-five (25) simulated hours as described in claim 1 wherein said indicia includes a set of numerals "1–12" on each side of said clock face and an additional representation of a 25th simulated hour in said twenty-five (25) hour simulated day.

6. A clock, comprising:

a clock face having indicia printed thereon at twenty-five (25) equally-spaced intervals, each of said intervals representing a simulated hour in a twenty-five (25) hour simulated day;

clock hand means including an hour hand, a minute hand, and a second hand for cooperating with said clock face to provide a time indication; and drive means for simultaneously driving said second hand around said clock face in 24/25th's of a real-time minute, said hand around said clock face in 24/25th's of a real-time hour, and said hour hand between spaced intervals in 1/25th of said twenty-four (24) hour real-time day, whereby said clock represents twenty-five (25) simulated hours in a twenty-four (24) hour real-time day.

7. A clock, comprising:

a clock face having two sets of numerals "1–12" and additional indicia printed thereon at twenty-five (25) equally-spaced intervals, each of said intervals representing a simulated hour in a twenty-five (25) hour simulated day;

clock hand means including an hour hand, minute hand and second hand for cooperating with said clock face to provide a time indication; and drive means for simultaneously driving said second hand around said clock face in 24/15th's of a real-time minute, said minute hand around said clock face in 24/25th's of real-time hour, and said hour hand between spaced intervals in 1/25th of said twenty-four (24) hour real-time day, whereby said clock represents twenty-five (25) simulated hours in a twenty-four (24) hour real-time day.

* * * * *